US007400300B2

(12) United States Patent
Qi et al.

(10) Patent No.: US 7,400,300 B2
(45) **Date of Patent: *Jul. 15, 2008**

(54) MULTIPLE-ELEMENT ANTENNA WITH FLOATING ANTENNA ELEMENT

(75) Inventors: Yihong Qi, Waterloc (CA); Ying Tong Man, Kitchener (CA); Michael E. Certain, Kitchener (CA); Perry Jarmuszewski, Waterloo (CA)

(73) Assignee: Research In Motion Limited, Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/590,200

(22) Filed: Oct. 31, 2006

(65) Prior Publication Data

US 2007/0176835 A1 Aug. 2, 2007

Related U.S. Application Data

(63) Continuation of application No. 10/864,145, filed on Jun. 9, 2004, now Pat. No. 7,148,846.

(30) Foreign Application Priority Data

Jun. 12, 2003 (EP) ..... 03253713

(51) Int. Cl.
*H01Q 1/38* (2006.01)
*H01Q 1/24* (2006.01)
*H01Q 19/10* (2006.01)

(52) U.S. Cl. ..... 343/700 MS; 343/702; 343/818

(58) Field of Classification Search ..... 343/700 MS, 343/702, 818

See application file for complete search history.

(56) References Cited

U.S. PATENT DOCUMENTS 3,521,284 A 7/1970 Shelton, Jr. et al.

(Continued)

FOREIGN PATENT DOCUMENTS

EP 0543645 5/1993

(Continued)

OTHER PUBLICATIONS

Antenna Frequency Scaling: The ARRL Antenna Book, p. 2.24-2.25, 1988.

(Continued)

*Primary Examiner*—Shih-Chao Chen
(74) *Attorney, Agent, or Firm*—Jones Day; Krishna K. Pathiyal; Robert C. Liang

(57) ABSTRACT

A multiple-element antenna for a wireless communication device is provided. The antenna comprises a first antenna element having a first operating frequency band and a floating antenna element positioned adjacent the first antenna element to electromagnetically couple to the first antenna element. The floating antenna element is configured to operate in conjunction with the first antenna element within a second operating frequency band. A feeding port connected to the first antenna element connects the first antenna element to communications circuitry and exchanges communication signals in both the first operating frequency band and the second operating frequency band between the multiple-element antenna and the communications circuitry. In a wireless mobile communication device having a transceiver and a receiver, the feeding port is connected to both the transceiver and the receiver.

48 Claims, 10 Drawing Sheets

U.S. PATENT DOCUMENTS

| | | | | |
|---|---|---|---|---|
| 3,599,214 | A | 8/1971 | Altamayer | |
| 3,622,890 | A | 11/1971 | Fujimoto et al. | |
| 3,683,376 | A | 8/1972 | Pronovost | |
| 4,024,542 | A | 5/1977 | Ikawa et al. | |
| 4,074,270 | A | 2/1978 | Kaloi | |
| 4,403,222 | A | 9/1983 | Bitter, Jr. et al. | |
| 4,471,493 | A | 9/1984 | Schober | |
| 4,504,834 | A | 3/1985 | Garay et al. | |
| 4,543,581 | A | 9/1985 | Nemet | |
| 4,571,595 | A | 2/1986 | Phillips et al. | |
| 4,584,709 | A | 4/1986 | Kneisel et al. | |
| 4,590,614 | A | 5/1986 | Erat | |
| 4,692,769 | A | 9/1987 | Gegan | |
| 4,730,195 | A | 3/1988 | Phillips et al. | |
| 4,839,660 | A | 6/1989 | Hadzoglou | |
| 4,847,629 | A | 7/1989 | Shimazaki | |
| 4,857,939 | A | 8/1989 | Shimazaki | |
| 4,890,114 | A | 12/1989 | Egashira | |
| 4,894,663 | A | 1/1990 | Urbish et al. | |
| 4,975,711 | A | 12/1990 | Lee | |
| 5,030,963 | A | 7/1991 | Tadama | |
| 5,138,328 | A | 8/1992 | Zibrik et al. | |
| 5,214,434 | A | 5/1993 | Hsu | |
| 5,218,370 | A | 6/1993 | Blaese | |
| 5,227,804 | A | 7/1993 | Oda | |
| 5,245,350 | A | 9/1993 | Sroka | |
| 5,257,032 | A | 10/1993 | Diamond et al. | |
| 5,347,291 | A | 9/1994 | Moore | |
| 5,373,300 | A | 12/1994 | Jenness et al. | |
| 5,389,937 | A * | 2/1995 | Kaloi | 343/700 MS |
| 5,420,599 | A | 5/1995 | Erkocevic | |
| 5,422,651 | A | 6/1995 | Chang | |
| 5,451,965 | A | 9/1995 | Matsumoto | |
| 5,451,968 | A | 9/1995 | Emery | |
| 5,457,469 | A | 10/1995 | Diamond et al. | |
| 5,489,914 | A | 2/1996 | Breed | |
| 5,493,702 | A | 2/1996 | Crowley et al. | |
| 5,541,609 | A | 7/1996 | Stutzman et al. | |
| 5,684,672 | A | 11/1997 | Karidis et al. | |
| 5,701,128 | A | 12/1997 | Okada et al. | |
| 5,767,811 | A | 6/1998 | Mandai et al. | |
| 5,821,907 | A | 10/1998 | Zhu et al. | |
| 5,841,403 | A | 11/1998 | West | |
| 5,870,066 | A | 2/1999 | Asakura et al. | |
| 5,872,546 | A | 2/1999 | Ihara et al. | |
| 5,903,240 | A | 5/1999 | Kawahata et al. | |
| 5,966,098 | A | 10/1999 | Qi et al. | |
| 5,973,651 | A | 10/1999 | Suesada et al. | |
| 5,977,920 | A | 11/1999 | Hung | |
| 5,990,838 | A | 11/1999 | Burns et al. | |
| 6,008,773 | A | 12/1999 | Matsuoka et al. | |
| 6,028,568 | A | 2/2000 | Asakura et al. | |
| 6,031,505 | A | 2/2000 | Qi et al. | |
| 6,034,639 | A | 3/2000 | Rawlins et al. | |
| 6,040,803 | A * | 3/2000 | Spall | 343/700 MS |
| 6,140,966 | A | 10/2000 | Pankinaho | |
| 6,181,282 | B1 | 1/2001 | Gans | |
| 6,222,503 | B1 | 4/2001 | Gietema et al. | |
| 6,329,951 | B1 | 12/2001 | Wen et al. | |
| 6,335,706 | B1 | 1/2002 | Elliot | |
| 6,337,667 | B1 | 1/2002 | Ayala et al. | |
| 6,408,190 | B1 | 6/2002 | Ying | |
| 6,456,249 | B1 | 9/2002 | Johnson et al. | |
| 6,509,882 | B2 * | 1/2003 | McKivergan | 343/818 |
| 6,515,634 | B2 | 2/2003 | Desclos et al. | |
| 6,664,930 | B2 | 12/2003 | Wen et al. | |
| 6,697,023 | B1 | 2/2004 | Tiao-Hsing et al. | |
| 6,781,548 | B2 | 8/2004 | Wen et al. | |
| 6,791,500 | B2 | 9/2004 | Qi et al. | |
| 6,839,038 | B2 | 1/2005 | Weinstein | |
| 6,920,315 | B1 | 7/2005 | Wilcox et al. | |
| 7,148,846 | B2 * | 12/2006 | Qi et al. | 343/700 MS |
| 2001/0001554 | A1 | 5/2001 | Oshiyama | |
| 2001/0050643 | A1 | 12/2001 | Egorov et al. | |
| 2002/0101380 | A1 | 8/2002 | Pruss et al. | |
| 2002/0140607 | A1 | 10/2002 | Zhou | |
| 2003/0011521 | A1 | 1/2003 | Edimo et al. | |
| 2003/0228885 | A1 | 12/2003 | Hattori et al. | |
| 2005/0093750 | A1 | 5/2005 | Vance | |

FOREIGN PATENT DOCUMENTS

| | | |
|---|---|---|
| EP | 0571124 | 11/1993 |
| EP | 0765001 | 3/1997 |
| EP | 0814536 | 12/1997 |
| EP | 0892459 | 1/1999 |
| EP | 1018779 | 7/2000 |
| EP | 1172885 | 1/2002 |
| EP | 1189304 | 3/2002 |
| EP | 1296410 | 3/2003 |
| EP | 1304765 | 4/2003 |
| GB | 2330951 | 5/1999 |
| JP | 55147806 | 11/1980 |
| JP | 5007109 | 1/1993 |
| JP | 5129816 | 5/1993 |
| JP | 5267916 | 10/1993 |
| JP | 5347507 | 12/1993 |
| JP | 0697712 | 4/1994 |
| JP | 6204908 | 7/1994 |
| WO | WO 91/12637 | 8/1991 |
| WO | 9638881 | 5/1996 |
| WO | 9733338 | 9/1997 |
| WO | 9812771 | 3/1998 |
| WO | 9903166 | 1/1999 |
| WO | 9925042 | 5/1999 |
| WO | 0001028 | 1/2000 |
| WO | 0108260 | 2/2001 |
| WO | 0171844 | 9/2001 |
| WO | 0178192 | 10/2001 |
| WO | 0191236 | 11/2001 |
| WO | 0254539 | 7/2002 |
| WO | 0347031 | 6/2003 |

OTHER PUBLICATIONS

Extended European Search Report, issued by European Patent Office on Mar. 12, 2008, for Application No. EP08101022.

* cited by examiner

MULTIPLE-ELEMENT ANTENNA WITH FLOATING ANTENNA ELEMENT

PRIORITY

This application is a continuation of application Ser. No. 10/864,145, filed on Jun. 9, 2004 now U.S. Pat. No. 7,148,846.

FIELD OF THE INVENTION

This invention relates generally to the field of antennas. More specifically, a multiple-element antenna is provided that is particularly well-suited for use in wireless communication devices such as Personal Digital Assistants (PDAs), cellular telephones, and wireless two-way email communication devices.

BACKGROUND OF THE INVENTION

Mobile communication devices ("mobile devices") having antenna structures that support communications in multiple operating frequency bands are known. Many different types of antennas for mobile devices are also known, including helix, "inverted F", folded dipole, and retractable antenna structures. Helix and retractable antennas are typically installed outside a mobile device, and inverted F and folded dipole antennas are typically embedded inside a mobile device case or housing. Generally, embedded antennas are preferred over external antennas for mobile devices for mechanical and ergonomic reasons. Embedded antennas are protected by the mobile device case or housing and therefore tend to be more durable than external antennas. Although external antennas may physically interfere with the surroundings of a mobile device and make a mobile device difficult to use, particularly in limited-space environments, embedded antennas present fewer such challenges. In some types of mobile device, however, known embedded antenna structures and design techniques are not feasible where operation in multiple dissimilar frequency bands is required.

SUMMARY

According to an aspect of the invention, a multiple-element antenna for a wireless communication device comprises a first antenna element having a first operating frequency band, a floating antenna element positioned adjacent the first antenna element to electromagnetically couple to the first antenna element and configured to operate in conjunction with the first antenna element within a second operating frequency band, and a feeding port connected to the first antenna element and configured to connect the first antenna element to communications circuitry and to exchange communication signals in both the first operating frequency band and the second operating frequency band between the multiple-element antenna and the communications circuitry.

A multiple-element antenna in accordance with another aspect of the invention, for use with a wireless mobile communication device having a transceiver and a receiver, comprises a single dielectric substrate, a first antenna element on the dielectric substrate having a feeding port connected to the transceiver and the receiver, and a floating antenna element on the dielectric substrate and positioned adjacent the first antenna element on the single dielectric substrate to electromagnetically couple with the first antenna element.

DETAILED DESCRIPTION

In a multiple-element antenna, different antenna elements are typically tuned to different operating frequency bands, thus enabling a multiple-element antenna to function as the antenna in a multi-band mobile communication device. For example, suitably tuned separate antenna elements enable a multiple-element antenna for operation at the Global System for Mobile Communications (GSM) and General Packet Radio Service (GPRS) frequency bands at approximately 900 MHz and 1800 MHz or 1900 MHz, or at the Code Division Multiple Access (CDMA) frequency bands at approximately 800 MHz and 1900 MHz.

Where operating frequency bands are relatively closely spaced, within 100-200 MHz, or sometimes where the bands are harmonically related, a single antenna element may be configured for multi-band operation. In a GPRS mobile device, for example, operation in all three frequency bands may be desired to support communications in networks in different countries or regions using a common antenna structure. In one known antenna design, tri-band operation is achieved using only two antenna structures connected to respective transceivers, including one antenna element tuned to 900 MHz, and another antenna element tuned for operation within a broader frequency band including the two other frequency bands at 1800 MHz and 1900 MHz. This type of antenna structure enables three operating frequency bands using only two antenna elements.

However, as those skilled in the art of antenna design will appreciate, such wide-band operation of an antenna element sacrifices performance of the antenna element in at least one of the frequency bands covered by the broad operating frequency band. Separate antenna elements tuned to each of the two frequency bands generally exhibit better performance at each operating frequency band than a similar antenna element configured for wide-band operation. In addition, this wide-band technique is practical only for relatively closely spaced operating frequency bands, as described above. Although a single antenna element may be configured to operate at multiple similar or closely spaced frequency bands, operation in further "dissimilar" frequency bands is typically supported using a separate antenna element having its own feeding port for connection to communications circuitry. As described in further detail below, multiple-element antennas according to aspects of the present invention include a first antenna element configured for operation in a first operating frequency band and a floating antenna element configured for operation in conjunction with the first antenna element at a second operating frequency band.

Figure 1:
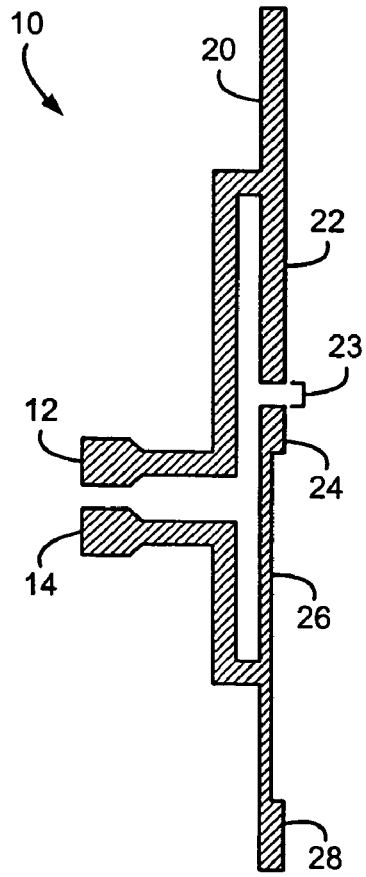
FIG. 1 is a top view of a first antenna element.

FIG. 1 is a top view of a first antenna element. The first antenna element 10 includes a first conductor section 22 and a second conductor section 26. The first and second conductor sections 22 and 26 are positioned to define a gap 23, thus forming an open-loop structure known as an open folded dipole antenna. In alternative embodiments, other antenna designs may be utilized, such as a closed folded dipole structure, for example.

The first conductor section 22 includes a top load 20 that is used to set an operating frequency band of the first antenna element 10. As described briefly above, this operating frequency band may be a wide frequency band containing multiple operating frequency bands, such as 1800 MHz and 1900 MHz. The dimensions of the top load 20 affect the total electrical length of the first antenna element 10, and thus may be adjusted to tune the first antenna element 10. For example, decreasing the size of the top load 20 increases the frequency of the operating frequency band of the first antenna element 10 by decreasing its total electrical length. In addition, the frequency of the operating frequency band of the first antenna element 10 may be further tuned by adjusting the size of the gap 23 between the conductor sections 22 and 26, or by altering the dimensions of other portions of the first antenna element 10.

The second conductor section 26 includes a stability patch 24 and a load patch 28. The stability patch 24 is a controlled coupling patch which affects the electromagnetic coupling between the first and second conductor sections 22 and 26 in the operating frequency band of the first antenna element 10. The electromagnetic coupling between the conductor sections 22 and 26 is further affected by the size of the gap 23, which is selected in accordance with desired antenna characteristics.

The first antenna element 10 also includes two ports 12 and 14, one connected to the first conductor section 22 and the other connected to the second conductor section 26. The ports 12 and 14 are offset from the gap 23 between the conductor sections 22 and 26, resulting in a structure commonly referred to as an "offset feed" open folded dipole antenna. However, the ports 12 and 14 need not necessarily be offset from the gap 23, and may be positioned, for example, to provide space for, or so as not to physically interfere with, other components of a mobile device in which the first antenna element 10 is implemented. The ports 12 and 14 are configured to couple the first antenna element 10 to communications circuitry. In one embodiment, the port 12 is coupled to a ground plane, while the port 14 is coupled to a signal source. The ground and signal source connections may be reversed in alternate embodiments, with the port 12 being coupled to a signal source and the port 14 being grounded. Although not shown in FIG. 1, those skilled in the art will also appreciate that either or both of the ports 12 and 14 may be connected to a matching network, in order to match impedance of the first antenna element 10 with the impedance of a communications circuit or device to which the antenna element 10 is coupled.

Figure 2:
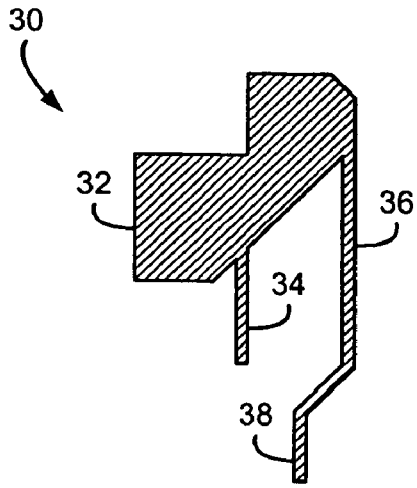
FIG. 2 is a top view of a floating antenna element.

FIG. 2 is a top view of a floating antenna element. The floating antenna element 30 includes a patch 32, and conductor sections 34, 36, and 38. Those skilled in the art will appreciate that the dimensions of the patch 32 affect the operating frequency band and gain of an antenna incorporating the floating antenna element 30. As will be described in further detail below, the dimensions of the conductor sections 34, 36, and 38 control the electromagnetic coupling between the floating antenna element 30 and another antenna element in conjunction with which it operates, and thus also affect the operating characteristics of an antenna including the floating antenna element 30. Unlike the first antenna element 10, the floating antenna element 30 does not include a feeding port, and is intended to operate in conjunction with another antenna element.

Figure 3:
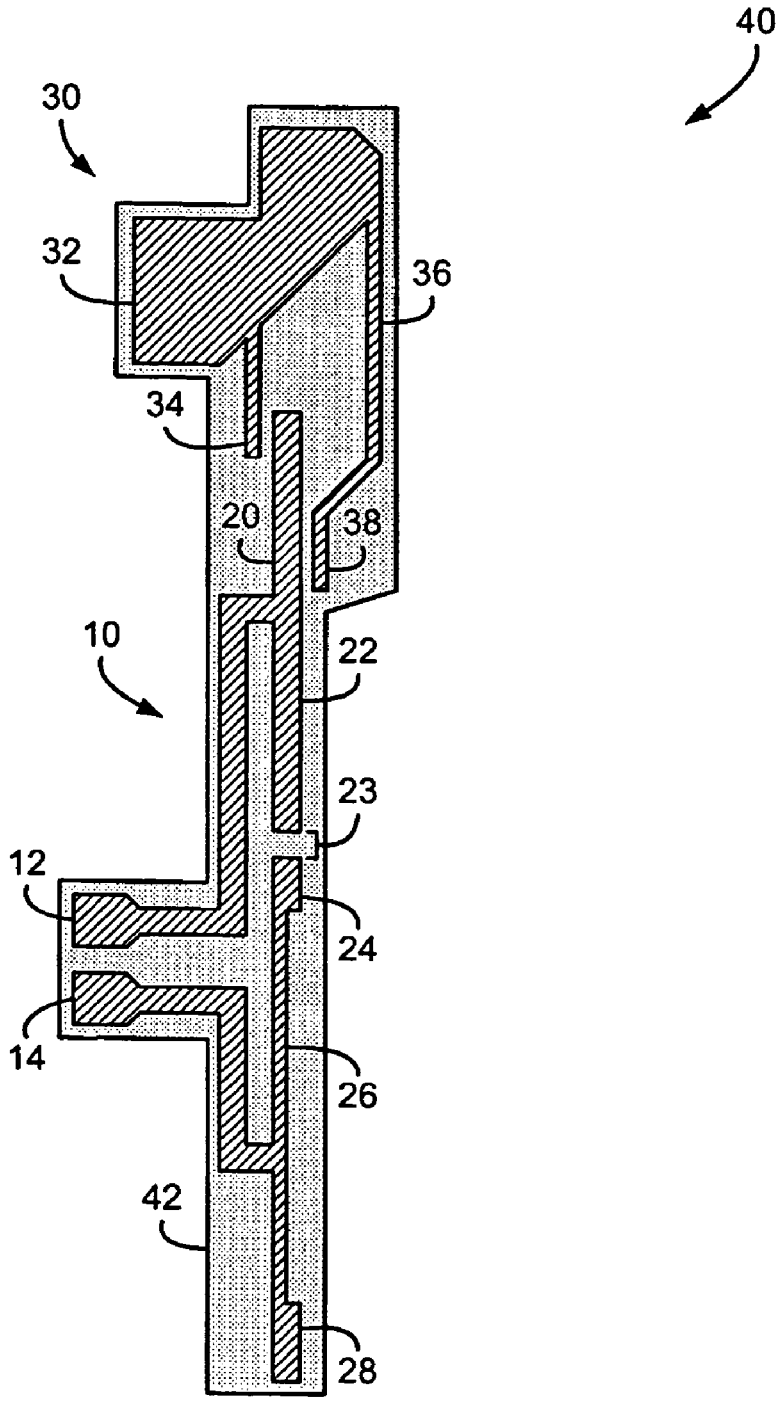
FIG. 3 is a top view of a multiple-element antenna including the antenna elements of FIGS. 1 and 2.

FIG. 3 is a top view of a multiple-element antenna including the antenna elements of FIGS. 1 and 2. In the multiple-element antenna 40, the first antenna element 10 as shown in FIG. 1 and the floating antenna element 30 of FIG. 2 are positioned in close proximity to each other, such that at least a portion of the first antenna element 10 is adjacent at least a portion of the floating antenna element 30. The multiple-element antenna 40 is fabricated on a flexible dielectric substrate 42, using copper conductor and known copper etching techniques, for example. The antenna elements 10 and 30 are fabricated such that a portion of the first antenna element 10, the top load 20 of the first conductor section 22 in FIG. 3, is adjacent to and partially overlaps the conductor sections 34, 36, and 38 of the floating antenna element 30. The proximity of the first antenna element 10 and the floating antenna element 30 results in electromagnetic coupling between the two antenna elements 10 and 30.

The first antenna element 10 is either tuned to optimize a single frequency band, such as the CDMA Personal Communication System (PCS) 1900 MHz band, or configured for wide-band operation in multiple frequency bands, such as GSM-1800 (1800 MHz), also known as DCS, and GSM-1900 (1900 MHz) in a GPRS device, for example. The floating antenna element 30 is tuned to optimize a dissimilar operating frequency band of the multiple-element antenna 40. The dissimilar operating frequency band is determined by the overall length of the first antenna element 10 and the floating antenna element 30. In one embodiment of the invention, the floating antenna 30 enables the multiple-element antenna 40 to receive Global Positioning System (GPS) signals in a frequency band of 1575 MHz, although it should be appreciated that the invention is in no way restricted thereto. The principles described herein may also be applied to other frequency bands.

As described above, the operating characteristics of the first antenna element 10 are controlled by adjusting the dimensions of the conductor sections 22 and 26 and the size of the gap 23 between the first and second conductor sections 22 and 26. For example, the gap 23 is adjusted to tune the first antenna element 10 to a selected first operating frequency band by optimizing antenna gain and performance at a particular frequency within the first operating frequency band. The dimensions of the stability patch 24 and the gap 23 affect the input impedance of the first antenna element 10, and as such are also adjusted to improve impedance matching between the first antenna element 10 and communications circuitry to which it is connected. In a similar manner, the dimensions of the patch 32 affect the operating frequency band, gain, and impedance of the multiple-element antenna 40.

The dimensions of each of the antenna elements 10 and 30 and the spacing therebetween also control the electromagnetic coupling between the antenna elements. Proper control of the electromagnetic coupling between the antenna elements 10 and 30 provides for substantially independent tuning of each operating frequency band. The dimensions of each antenna element 10 and 30 and its position relative to the other antenna element are therefore adjusted so that the antenna element 10 and the antenna 40 are optimized within their respective operating frequency bands. In the multiple-element antenna 40, the conductor sections 34 and 38, and to a lesser degree, the conductor section 36, overlap portions of the top load 20 of the first antenna element 10. These portions of the antenna elements 10 and 30 primarily control the strength of the electromagnetic coupling between the antenna elements 10 and 30, as well as the impedance, particularly capacitance, of the multiple-element antenna 40.

In operation, the first antenna element 10 of the multiple-element antenna 40 enables communications in a first operating frequency band, and the combination of the first antenna element 10 and the floating antenna element 30 enable communications in a second operating frequency band.

The first antenna element 10 is operable to transmit and/or receive communication signals in the first operating frequency band. Although the floating antenna element 30 presents a top load to the first antenna element 10 due to the electromagnetic coupling described above, proper adjustment of the dimensions and placement of the antenna elements compensates for or reduces the effects of the floating antenna element 30 on the operation of the first antenna element 10 in the first operating frequency band. Thus, the first antenna element 10 forms the primary radiator for transmission and reception of communication signals in the first operating frequency band. Communication signals received by the first antenna element 10 are transferred to communications circuitry (not shown) to which the ports 12 and 14 are connected. Similarly, communications signals that are to be transmitted in the first operating frequency band are transferred to the first antenna element 10 through the ports 12 and 14. Transmission and reception functions in the first frequency band are dependent upon the type of communications circuitry to which the ports 12 and 14 are connected. For example, the communications circuitry may include a receiver, a transmitter, or a transceiver incorporating both a receiver and a transmitter.

Operation of the multiple-element antenna 40 in the second operating frequency band exploits the electromagnetic coupling between the floating antenna element 30 and the first antenna element 10. The first antenna element 10 and the floating antenna element 30 operate in combination to receive, and to transmit in some embodiments of the invention, communication signals in the second operating frequency band. These signals are transferred between the multiple-element antenna 40 and associated communications circuitry through the ports 12 and 14. The ports 12 and 14 of the first antenna element 10 thus act as a feeding port for both the first antenna element 10 and, through the electromagnetic coupling between the antenna elements 10 and 30, the multiple-element antenna 40.

As will be apparent from the foregoing description, the design of a multiple-element antenna such as 40 involves a trade off between loading the first antenna element 10 in the first operating frequency band and ensuring effective operation of the multiple-element antenna 40 in the second operating frequency band. Whereas the electromagnetic coupling between the antenna elements 10 and 30 introduces a top load to the first antenna element 10, this same coupling principle enables operation of the multiple-element antenna 40 in the second operating frequency band from the ports 12 and 14 of the first antenna element 10.

The communications circuitry associated with the first and second operating frequency bands is either a single receiver, transmitter, or transceiver configured to operate in multiple frequency bands, or distinct receivers, transmitters, transceivers, or some combination thereof for each frequency band. In one possible implementation, for example, the first operating frequency band is the 1900 MHz CDMA PCS frequency band, the second operating frequency band is the 1575 MHz GPS frequency band, and both a CDMA transceiver and a GPS receiver are connected to the ports 12 and 14.

FIG. 3 represents a multiple-element antenna according to one embodiment of the present invention. In alternative embodiments, the antenna elements 10 and 30 or parts thereof may overlap to a greater or lesser degree. For example, increasing the spacing between the top load 20 and the conductor section 38, or decreasing the lengths of the conductor section 34, 36, or 38 to thereby decrease the degree of overlap between the antenna elements 10 and 30 reduces the electromagnetic coupling between the antenna elements 10 and 30 and also affects the impedance of the multiple-element antenna 40. Those skilled in the art will also appreciate that electromagnetic coupling may be achieved without necessarily overlapping portions of the antenna elements 10 and 30. Therefore, other structures than the particular structure shown in FIG. 3 are also possible. The dimensions and spacing of antenna elements in such alternate structures, and thus the electromagnetic coupling between the antenna elements, are preferably adjusted so that optimum antenna efficiency and substantially independent antenna element tuning are achieved, as described above.

Figure 4:
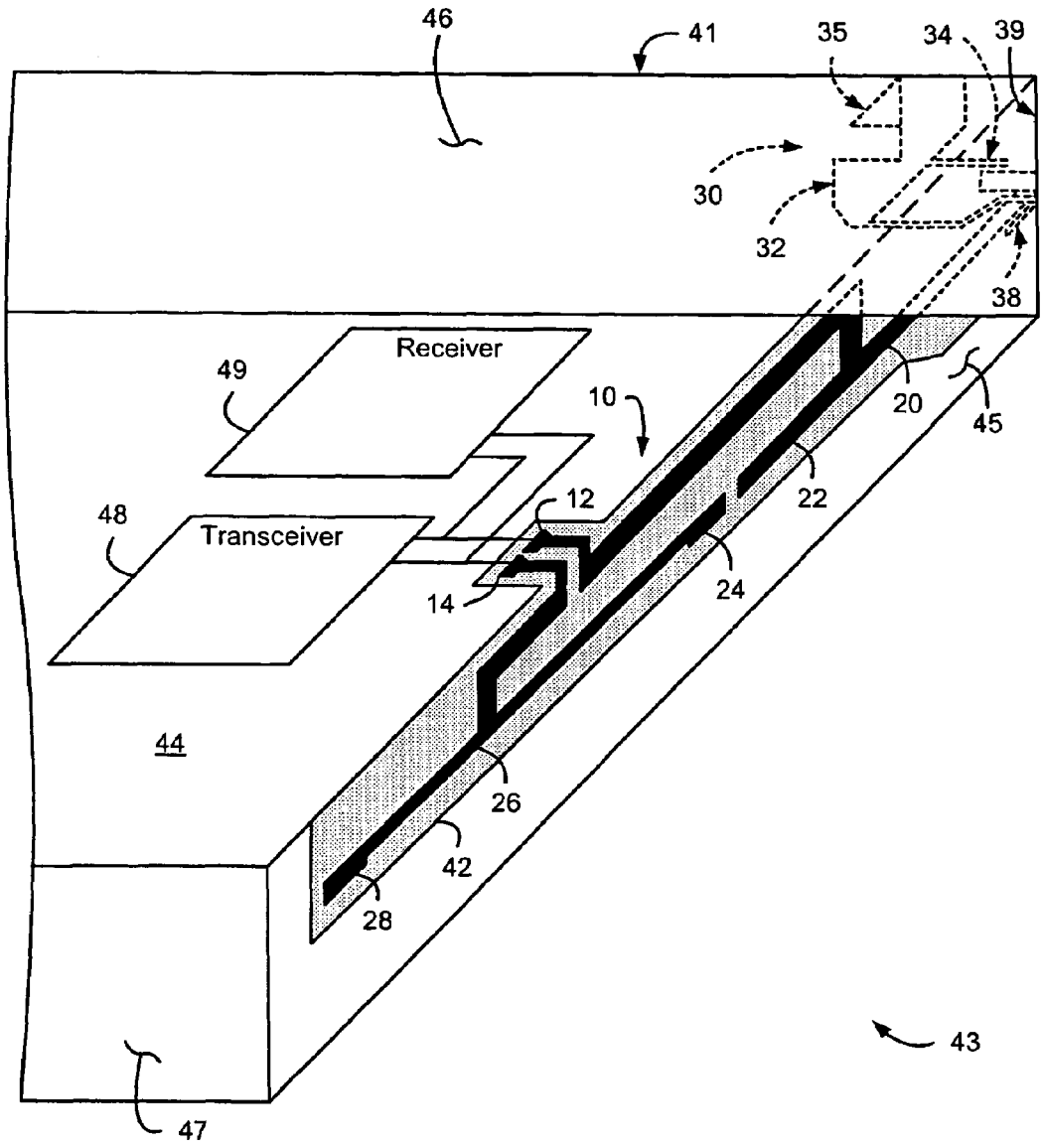
FIG. 4 is an orthogonal view of the multiple-element antenna of FIG. 3 mounted in a mobile communication device.

FIG. 4 is an orthogonal view of the multiple-element antenna of FIG. 3 mounted in a mobile communication device. Those skilled in the art will appreciate that a front housing wall and a majority of internal components of the mobile device 43, which would obscure the view of the antenna, have not been shown in FIG. 4. In an assembled mobile device, the embedded antenna shown in FIG. 4 is not visible.

The mobile device 43 comprises a case or housing having a front wall (not shown), a rear wall 44, a top wall 46, a bottom wall 47, and side walls, one of which is shown at 45. In addition, the mobile device 43 includes a transceiver 48 and a receiver 49 connected to the ports 12 and 14 of the first antenna element 10 and mounted within the housing.

Although the portion of the substrate 42 behind the top wall 46 has not been shown in FIG. 4 in order to avoid congestion in that portion of the drawing, it should be understood that the substrate extends along the side wall 45 and onto the top wall 46 at least as far as the end of the floating antenna element 30. Fabrication of the multiple-element antenna 40 on the substrate 42, preferably a flexible dielectric substrate, facilitates handling of the antenna before and during installation in the mobile device 43.

The multiple-element antenna, including the substrate 42 on which the antenna is fabricated, is mounted on the inside of the housing of the mobile device 43. The substrate 42 and thus the multiple-element antenna is folded from an original, substantially flat configuration such as illustrated in FIG. 3, so as to extend around the inside surface of the mobile device housing to orient the antenna in multiple planes. The first antenna element 10 is folded and mounted along the rear, side, and top walls 44, 45, and 46. The ports 12 and 14 are mounted on the rear wall 44 and connected to both the transceiver 48 and the receiver 49. The first conductor section 22 extends along the side wall 45, around the top corner 39, and along and the top wall 46. The floating antenna element 30 similarly extends along the side wall 45, the top wall 46, and the rear wall 44. As shown, the floating antenna element is positioned partially on the top wall 46, with the conductor section 38 extending onto the side wall 45 and a portion 35 of the patch 32 extending around the top rear edge 41 onto the rear wall 44.

The ports 12 and 14 of the first antenna element 10 are connected to both the transceiver 48 and the receiver 49. Switching or routing of signals to and from one or the other of the transceiver 48 and the receiver 49 may be accomplished in many ways, as will be apparent to those skilled in the art. As described briefly above, the first antenna element 10 is configured for operation within the 1900 MHz CDMA PCS frequency band, the floating antenna element 30 operates in combination with the first antenna element 10 at the 1575 MHz GPS frequency band, the transceiver 48 is a CDMA PCS transceiver, and the receiver 49 is a GPS receiver in one possible implementation. Mounting of the floating antenna element 30 on the top wall 46 of the mobile device 43 is particularly advantageous for effective reception of signals from GPS satellites, since a mobile device is typically oriented with its top surface relatively unobstructed and facing toward the sky, when the mobile device is in use or stored in a storage cradle or carrying case, for example. In addition, other components of the mobile device 43 block radiation components associated with the floating antenna element 30 that are directed into the device. This blocking has a resultant beam-shaping effect that enhances components directed out of the top of the device and further improves GPS signal reception.

As shown, the patch 32 comprises a portion 35 which extends around the top rear edge 41 and onto the rear wall 44. This portion 35 is used, for example, where electromagnetic coupling between the floating antenna element 30 and other components of the mobile device 43 is desired. Such coupling to other device components provides a further degree of freedom for controlling the radiation pattern of the multiple-element antenna. Thus, in alternate embodiments, the patch 32 is mounted entirely or only partially on the top wall 46.

Although FIG. 4 shows one orientation of the multiple-element antenna within the mobile device 43, it should be appreciated that the antenna may be mounted in different ways, depending upon the type of housing, for example. In a mobile device with substantially continuous rear, top, side, and bottom walls, an antenna may be mounted directly to the housing. Many mobile device housings are fabricated in separate parts that are attached together when internal components of the mobile device have been placed. Often, the housing sections include a front section and a rear section, each including a portion of the top, side and bottom walls of the housing. Unless the portion of the top, side, and bottom walls in the rear housing section is of sufficient size to accommodate the antenna and the substrate, then mounting of the antenna on the housing as shown in FIG. 4 might not be practical. In such mobile devices, the antenna is preferably attached to an antenna frame that is integral with or adapted to be mounted on the mobile device housing, a structural member in the mobile device, or another component of the mobile device. Where the antenna is fabricated on a substrate, mounting or attachment of the antenna is preferably accomplished using an adhesive provided on or applied to the substrate, the component to which the antenna is mounted or attached, or both.

The mounting of the multiple-element antenna as shown in FIG. 4 is intended for illustrative purposes only. The multiple-element antenna or other similar antenna structures may be mounted on different surfaces of a mobile device or mobile device housing. For example, housing surfaces on which a multiple-element antenna is mounted need not necessarily be flat, perpendicular, or any particular shape. An antenna may also be mounted on fewer or further surfaces or planes than shown in FIG. 4.

Although the preceding description relates to a two-element antenna, it should be appreciated that a floating antenna element may be implemented in multiple-element antennas having more than one other antenna element. Illustrative examples of multiple-element antennas incorporating a first antenna element, a second antenna element, and a floating antenna element are described below.

Figure 5:
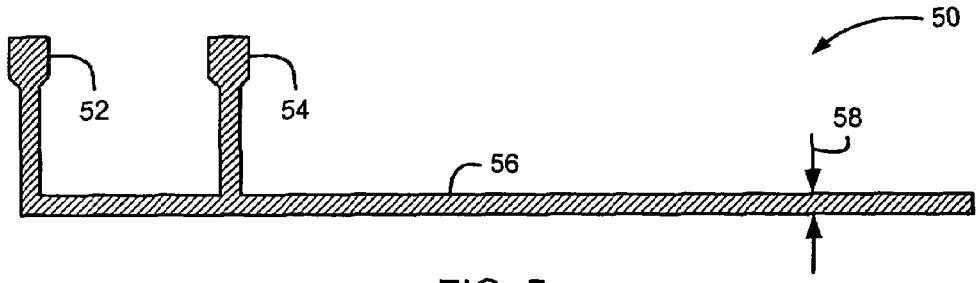
FIG. 5 is a top view of a second antenna element.

FIG. 5 is a top view of a second antenna element. The second antenna element 50 includes a first port 52, a second port 54, and a top conductor section 56 connected to the ports 52 and 54. As will be apparent to those skilled in the art, the ports 52 and 54 and the top conductor section 56 are normally fabricated from conductive material such as copper, for example. The length of the top conductor section 56 sets an operating frequency band of the second antenna element 50.

Figure 6:
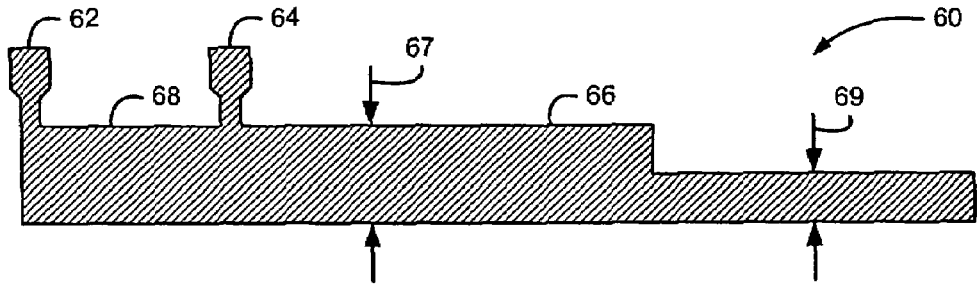
FIGS. 6-8 are top views of alternative second antenna elements.
Figure 7:
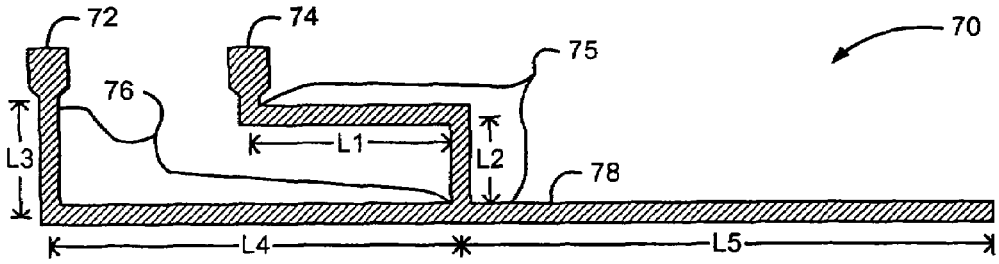
Figure 8:
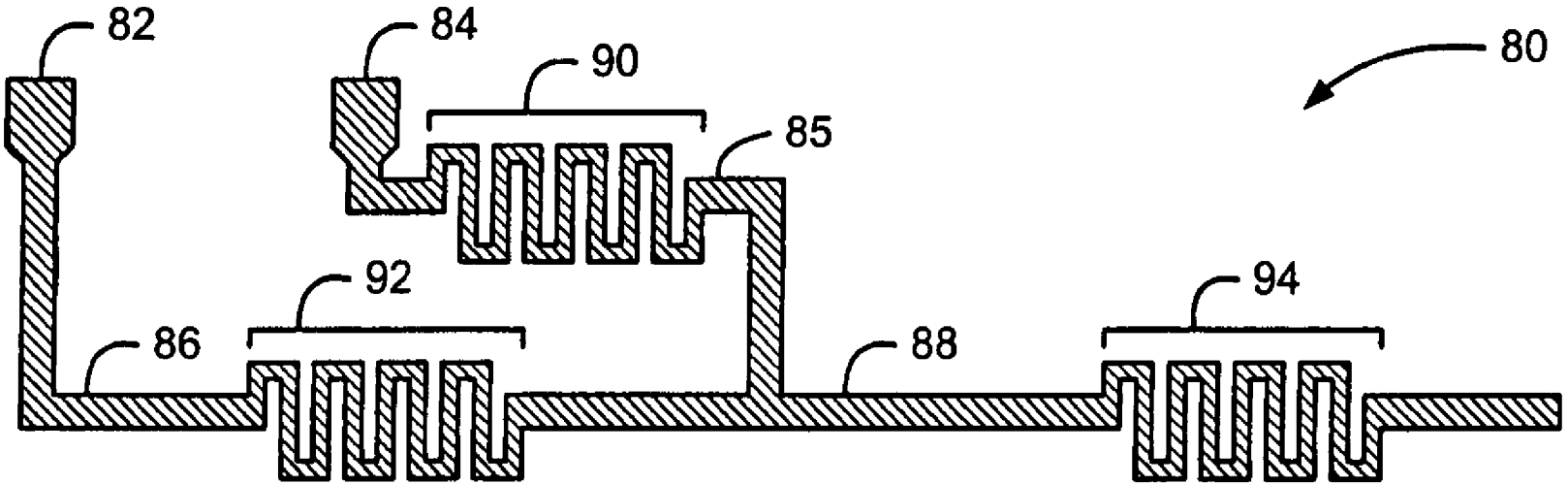

FIGS. 6-8 are top views of alternative second antenna elements. Whereas the top conductor section 56 of the second antenna element 50 has substantially uniform width 58, the alternative second antenna element 60 shown in FIG. 6 has a top conductor section 66 with non-uniform width. As shown in FIG. 6, the portion 68 between the ports 62 and 64 and part of the top conductor section 66 of the antenna element 60 have a width 67, and an end portion of the antenna element 60 has a smaller width 69. A structure as shown in FIG. 6 is useful, for example, to provide space for other antenna elements, such as a parasitic coupler, in order to conserve space. As those skilled in the art will appreciate, the length and width of the antenna element 60 or portions thereof are selected to set gain, bandwidth, impedance match, operating frequency band, and other characteristics of the antenna element.

FIG. 7 shows a top view of a further alternative second antenna element. The antenna element 70 includes ports 72 and 74, and first, second and third conductor sections 75, 76 and 78. The operating frequency band of the antenna element 70 is primarily controlled by selecting the lengths of the second and third conductor sections 76 and 78. Any of the lengths L3, L4 and L5 may be adjusted to set the lengths of the second and third conductor sections 76 and 78, whereas the length of the first conductor section 75 may be set for impedance matching purposes by adjusting the lengths L1, L2, or both. Although the lengths of the first, second and third conductor sections are adjusted to control the above operating characteristics of the antenna element 70, adjustment of the length of any of these conductor sections has some effect on the characteristic controlled primarily by the other antenna conductor sections. For example, increasing L3, L4 or L5 to decrease the operating frequency band of the antenna element 70 may also necessitate adjustment of one or both of the lengths L1 and L2, since changing L3, L4 or L5 also affects the impedance and thus the matching of the antenna element 70.

Any of the first, second and third conductor sections of the antenna element 70 may include a structure to increase its electrical length, such as a meandering line or sawtooth pattern, for example. FIG. 8 is a top view of another alternative first antenna element, similar to the antenna element 70, including ports 82 and 84 and meandering lines 90, 92 and 94 to increase the electrical length of the first, second and third conductor sections 85, 86 and 88. The meandering lines 92 and 94 change the lengths of the second and third conductor sections 86 and 88 of the second antenna element 80 in order to tune it to a particular operating frequency band. The meandering line 94 also top-loads the second antenna element 80 such that it operates as though its electrical length were greater than its actual physical dimension. The meandering line 90 similarly changes the electrical length of the first conductor section for impedance matching. The electrical length of the any of the meandering lines 90, 92 and 94, and thus the total electrical length of the first, second and third conductor sections 85, 86 and 88, may be adjusted, for example, by connecting together one or more segments of the meandering lines to form a solid conductor section.

Figure 9:
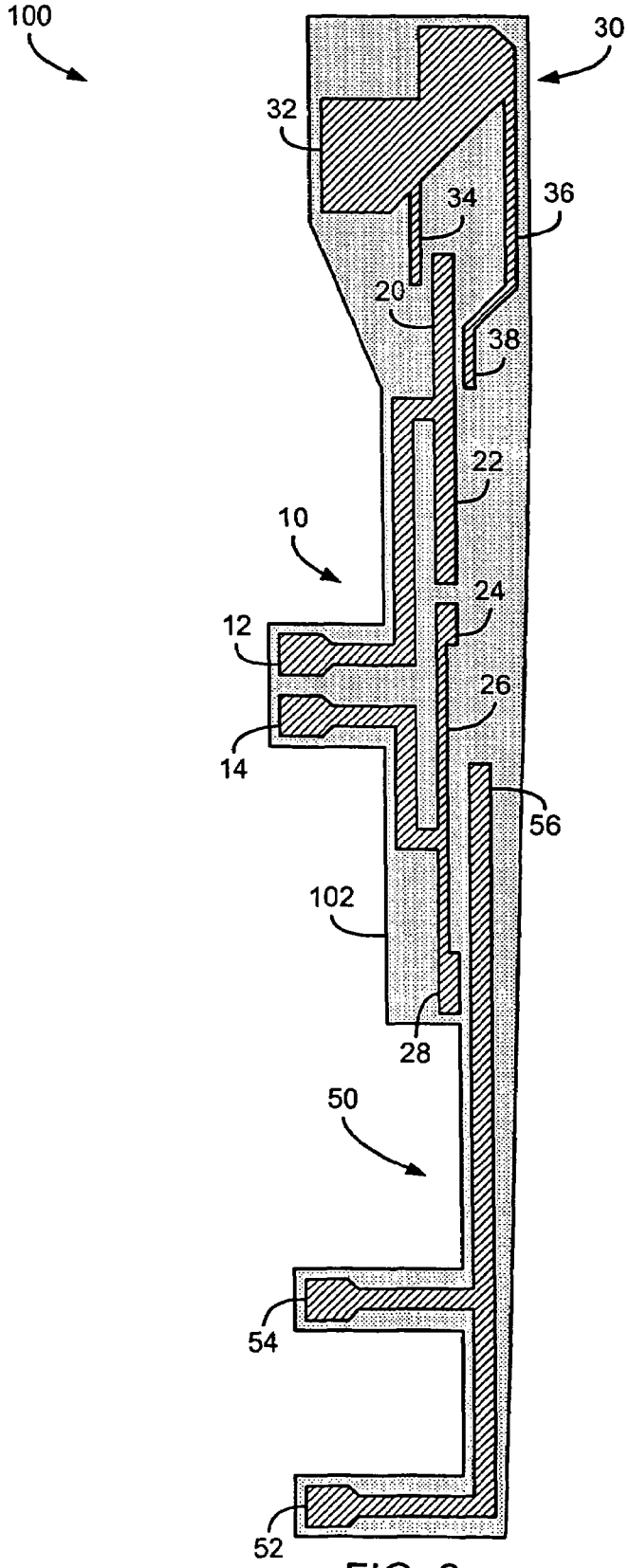
FIG. 9 is a top view of a multiple-element antenna including a first antenna element, a second antenna element, and a floating antenna element.

FIG. 9 is a top view of a multiple-element antenna including a first antenna element, a second antenna element, and a floating antenna element. In the multiple-element antenna 100, a first antenna element 10 and a floating antenna element 30 are positioned adjacent each other on a substrate 102. The floating antenna 30 operates in conjunction with the first antenna element 10 substantially as described above.

The second antenna element 50 as shown in FIG. 5 is positioned such that at least a portion of the second antenna element 50 is adjacent at least a portion of the first antenna element 10. In FIG. 9, the antenna elements 10 and 50 are fabricated on the substrate 102 such that a portion of the top conductor section 56 of the second antenna element 50 is adjacent to and partially overlaps the second conductor section 26 of the first second antenna element 10. The proximity of the first antenna element 10 and the second antenna element 50 results in electromagnetic coupling between the two antenna elements 10 and 50. Although the first antenna element 10 and the second antenna element 50 are typically tuned to optimize corresponding first and second operating frequency bands, each antenna element 10 and 50 acts as a parasitic element to the other due to the electromagnetic coupling therebetween, thus improving performance of the multiple-element antenna 100 by smoothing current distributions in each antenna element 10 and 50 and increasing the gain and bandwidth at the operating frequency bands of both the first and second antenna elements 10 and 50. For example, in a mobile device designed for operation in a GPRS network, the first operating frequency band may include both the GSM-1800 (1800 MHz) or DCS, and the GSM-1900 (1900 MHz) or PCS frequency bands, whereas the second operating frequency band is the GSM-900 (900 MHz) frequency band. In a CDMA mobile device, the first and second operating frequency bands may include the CDMA bands at approximately 1900 MHz and 800 MHz, respectively. Those skilled in the art will appreciate that the first and second antenna elements 10 and 50 may be tuned to other first and second operating frequency bands for operation in different communication networks.

FIG. 9 represents an illustrative example of a multiple-element antenna. The dimensions, shapes, and orientations of the various patches, gaps, and conductors that affect the electromagnetic coupling between the elements 10, 30, and 50 may be modified to achieve desired antenna characteristics. For example, although the second antenna element 50 is shown in the multiple-element antenna 100, any of the alternative antenna elements 60, 70, and 80, or a second antenna element combining some of the features of these alternative second antenna elements, could be used instead of the second antenna element 50. Other forms of the first antenna element 10 and the floating antenna element 30 may also be used in alternative embodiments.

Figure 10:
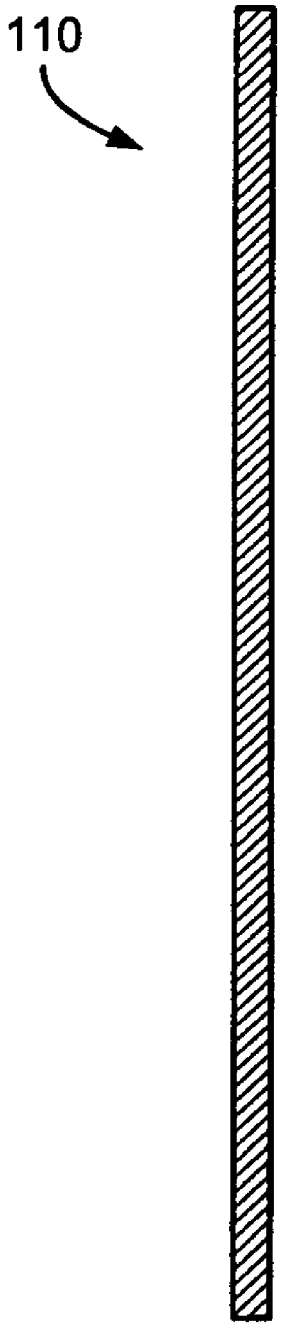
FIG. 10 is a top view of a parasitic coupler.

FIG. 10 is a top view of a parasitic coupler. A parasitic coupler is a parasitic element, a single conductor 110 in FIG. 10, which is used to improve electromagnetic coupling between first and second antenna elements, as described in further detail below, to thereby improve the performance of each antenna element in its respective operating frequency band and smooth current distributions in the antenna elements.

Figure 11:
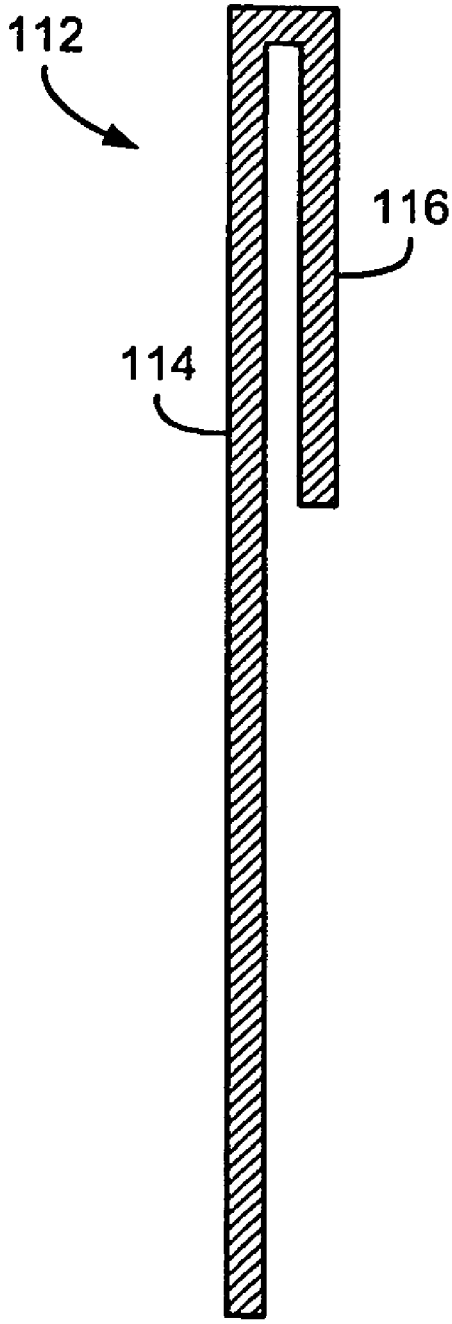
FIG. 11 is a top view of an alternative parasitic coupler.

A parasitic coupler need not necessarily be a substantially straight conductor as shown in FIG. 10. FIG. 11 is a top view of an alternative parasitic coupler. The parasitic coupler 112 is a folded or curved conductor which has a first conductor section 114 and a second conductor section 116. A parasitic coupler such as 112 is used, for example, where physical space limitations exist.

It should also be appreciated that a parasitic coupler may alternatively comprise adjacent, connected or disconnected, conductor sections. For example, two conductor sections of the type shown in FIG. 10 could be juxtaposed so that they overlap along substantially their entire lengths to form a "stacked" parasitic element. In a variation of a stacked parasitic element, the conductor sections only partially overlap, to form an offset stacked parasitic element. End-to-end stacked conductor sections represent a further variation of multiple-conductor section parasitic elements. Other parasitic element patterns or structures, adapted to be accommodated within available physical space or to achieve particular electromagnetic coupling and performance characteristics, will also be apparent to those skilled in the art.

Figure 12:
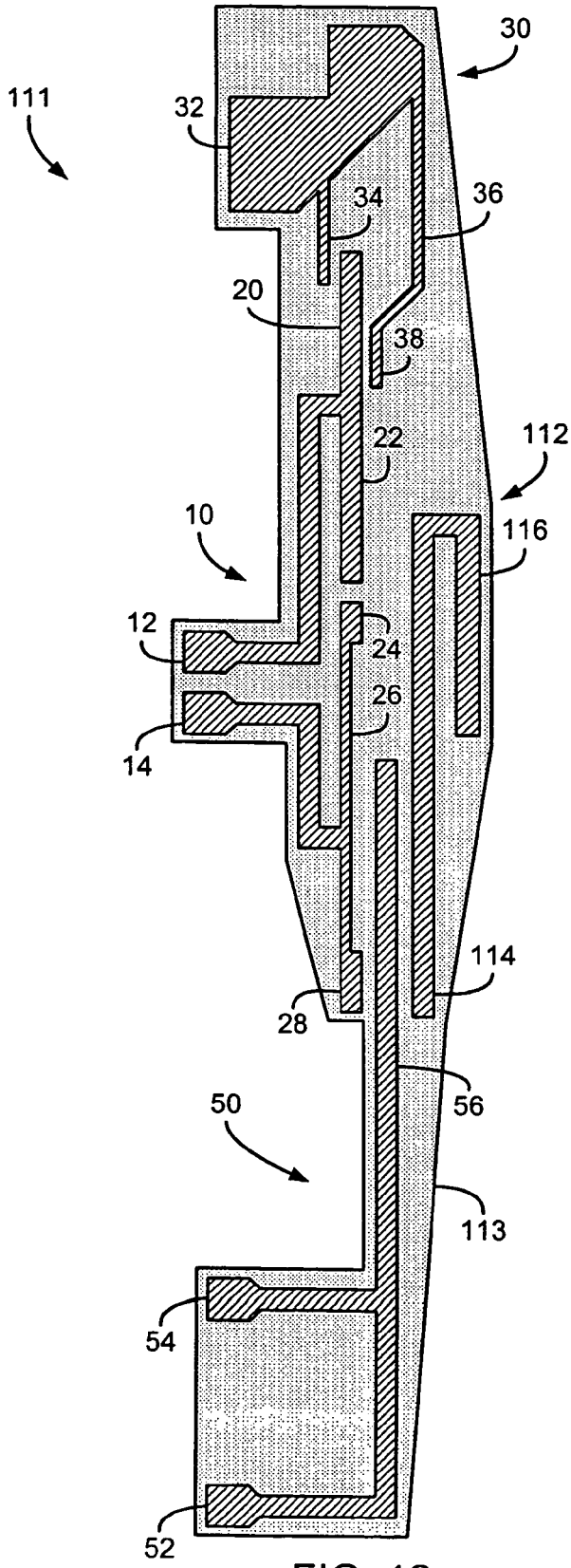
FIG. 12 is a top view of a further multiple-element antenna including a parasitic coupler.

FIG. 12 is a top view of a further multiple-element antenna including a parasitic coupler. The multiple-element antenna 111 includes the first and second antenna elements 10 and 50, the floating antenna element 30, and the parasitic coupler 112. As shown, the parasitic coupler 112 is adjacent to and overlaps a portion of both the first antenna element 10 and the second antenna element 50.

In the multiple-element antenna 111, part of the first conductor section 114 of the parasitic coupler 112 is positioned adjacent to the top conductor section 56 of the second antenna element 50 and electromagnetically couples therewith. The second conductor section 116 and a portion of the first conductor section 114 of the parasitic coupler 12 similarly overlap a portion of the first antenna element 10 in order to electromagnetically couple the parasitic coupler 112 with the first antenna element 10. The parasitic coupler 112 thereby electromagnetically couples with both the first antenna element 10 and the second antenna element 50.

The second antenna element 50 tends to exhibit relatively poor communication signal radiation and reception in some types of mobile devices. Particularly when implemented in a small mobile device, the length of the top conductor section 56 is limited by the physical dimensions of the mobile device, resulting in poor gain. The presence of the parasitic coupler 112 enhances electromagnetic coupling between the first antenna element 10 and the second antenna element 50. Since the first antenna element 10 generally has better gain than the second antenna element 50, this enhanced electromagnetic coupling to the first antenna element 10 improves the gain of the second antenna element 50 in its operating frequency band. When operating in its operating frequency band, the second antenna element 50, by virtue of its position relative to the first antenna element 10, electromagnetically couples to the second conductor section 26 of the first antenna element 10. Through the parasitic coupler 112, the second antenna element 50 is more strongly coupled to the second conductor section 26 and also electromagnetically couples to the first conductor section 22 of the first antenna element 10.

The parasitic coupler 112 also improves performance of the first antenna element 10, and thus, the performance of the multiple-element antenna 40 in all of its operating frequency bands. In particular, the parasitic coupler 112, through its electromagnetic coupling with the first antenna element 10, provides a further conductor to which current in the first antenna element 10 is effectively transferred, resulting in a more even current distribution in the first antenna element 10. Electromagnetic coupling from both the first antenna element 10 and the parasitic coupler 112 to the second antenna element 50 also disperses current in the first antenna element 10 and the parasitic coupler 112. This provides for an even greater capacity for smoothing current distribution in the first antenna element 10, in that current can effectively be transferred to both the parasitic coupler 112 and the second antenna element 50 when the first antenna element 10 is in operation, when a communication signal is being transmitted or received in an operating frequency band associated with either the first antenna element 10 or the multiple-element antenna 40, for example.

The length of the parasitic coupler 112, as well as the spacing between the first and second antenna elements 10 and 50 and the parasitic coupler 112, control the electromagnetic coupling between the antenna elements 10 and 50 and the parasitic coupler 112, and thus are adjusted to control the gain and bandwidth of the first antenna element 10 and the second antenna element 50 within their respective first and second operating frequency bands.

Operation of the antenna 111 is otherwise substantially as described above in conjunction with FIG. 9.

Although particular types of antenna elements and parasitic elements are shown in FIG. 12, the present invention is in no way restricted thereto. Alternative embodiments in which other types of elements are implemented are also contemplated, including, for example, antenna elements incorporating features of one or more of the alternative antenna elements in FIGS. 6-8. The relative positions of the various elements in the antenna 111 may also be different than shown in FIG. 12 for alternative embodiments. Electromagnetic coupling between the first and second antenna elements 10 and 50 is enhanced, for example, by locating the parasitic coupler 112 between the first and second antenna elements 10 and 50. Such an alternative structure provides tighter coupling between the antenna elements. However, an antenna such as the antenna 111, with a weaker coupling between the antenna elements, is useful when some degree of isolation between the first and second antenna elements 10 and 50 is desired.

Figure 13:
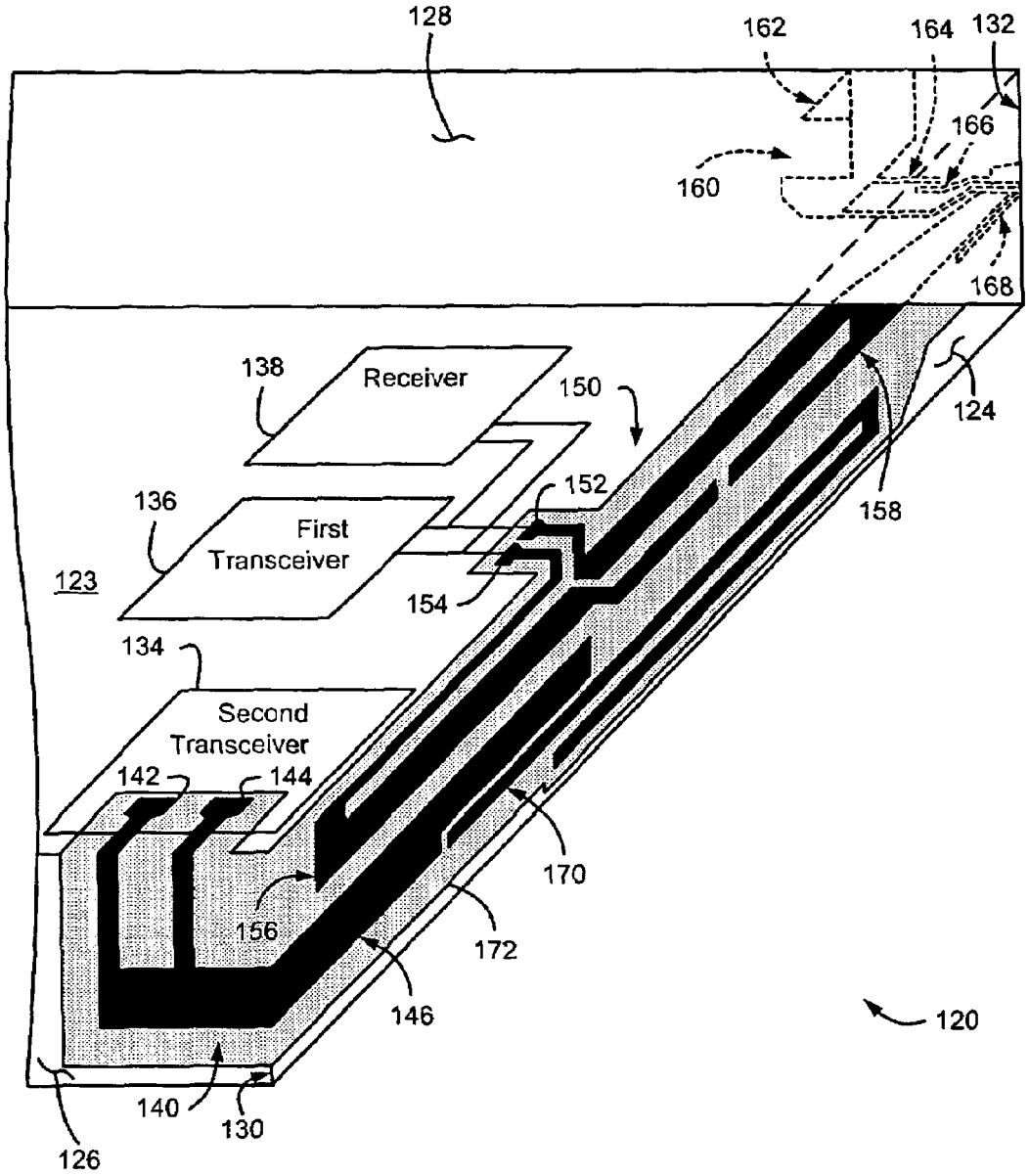
FIG. 13 is an orthogonal view of another multiple-element antenna mounted in a mobile communication device.

FIG. 13 is an orthogonal view of another multiple-element antenna mounted in a mobile communication device. As in FIG. 4, a front housing wall and a majority of internal components of the mobile device 120, which would obscure the view of the antenna, have not been shown in FIG. 13.

The mobile device 120 comprises a case or housing having a front wall (not shown), a rear wall 123, a top wall 128, a bottom wall 126, and side walls, one of which is shown at 124. In addition, the mobile device 120 includes a first transceiver 136, a second transceiver 134, and a receiver 138 mounted within the housing.

The multiple-element antenna shown in FIG. 13 is similar to the multiple-element antenna 111 in FIG. 12 in that it includes a first antenna element 150, a second antenna element 140, a floating antenna element 160, and a parasitic coupler 170. The first antenna element 150 is a dipole antenna element, having a port 152 connected to a first conductor section 158 and a second port 154 connected to a second conductor section 156. The ports 152 and 154 are also configured for connection to both the first transceiver 136 and the receiver 138, through one of many possible signal switching or routing arrangements (not shown). The second antenna element 140 is similar to the antenna element 50, and comprises ports 142 and 144, configured to be connected to the second transceiver 144, and a top conductor section 146. The antenna elements 140, 150, and 160 and the parasitic coupler 170 are fabricated on a substrate 172. As in FIG. 4, the portion of the substrate 172 behind the top wall 128 has not been shown in FIG. 13.

FIG. 13 shows further examples of the possible shapes and types of elements to which the present invention is applicable. The first antenna element 150 is a different dipole antenna element than the antenna element 10. For example, the first conductor section 158 includes an extension 166 which improves coupling between the first antenna element 10 and the floating antenna element 160, the port 154 is connected to one end of the second conductor section 156 instead of to an intermediate portion thereof, and both conductor sections are shaped differently than those in the antenna element 10. The second antenna element 140 is also different than the second antenna element 50 in the multiple-element antennas of FIGS. 9 and 12, in that the top conductor section 146 has non-uniform width, and includes a notch or cut-away portion in which the parasitic coupler 170 is nested. Further shape, size, and relative position variations will be apparent to those skilled in the art and as such are considered to be within the scope of the present invention.

The multiple-element antenna, including the substrate 172 on which the antenna is fabricated, is mounted inside the housing of the mobile device 120, directly on the housing, on a mounting frame attached to the housing or another structural part of the mobile device 120, or on some other part of the mobile device 120. The substrate 172 and thus the multiple-element antenna are folded from an original, substantially flat configuration such as illustrated in FIG. 12 to orient the antenna in multiple planes.

The first antenna element 150 is folded and mounted across the rear, side, and top walls 123, 124, and 128. The ports 152 and 154 are mounted on the rear wall 123 and connected to the first transceiver 136 and the receiver 138. The first conductor section 158 extends along the side wall 124, around the top corner 132, and along and the top wall 128. The second conductor section 156 of the first antenna element 150 is mounted on the side wall 124.

The top conductor section 146 of the second antenna element 140 is mounted on the side wall 124 and extends from the side wall 124 around a bottom corner 130 to the bottom wall 126. The ports 142 and 144 are mounted on the rear wall 123 of the housing and connected to the second transceiver 134. As shown, the parasitic coupler 170 is mounted to the side wall 124.

The floating antenna element 160 is mounted partially along the top housing wall 128, with a conductor section 164 on the top wall 128 and a conductor section 168 extending along the top wall 128, around the corner 132 and onto the side wall 124. The floating antenna element 160 also includes a patch, of which a portion 162 extends around a top rear edge of the housing and onto the rear wall 123. As described above, this location of the floating antenna 160 is particularly advantageous where the receiver 138 is a GPS receiver.

A mobile device in which a multiple-element antenna is implemented may, for example, be a data communication device, a voice communication device, a dual-mode communication device such as a mobile telephone having data communications functionality, a personal digital assistant (PDA) enabled for wireless communications, a wireless email communication device, or a wireless modem operating in conjunction with a laptop or desktop computer or some other electronic device or system.

Figure 14:
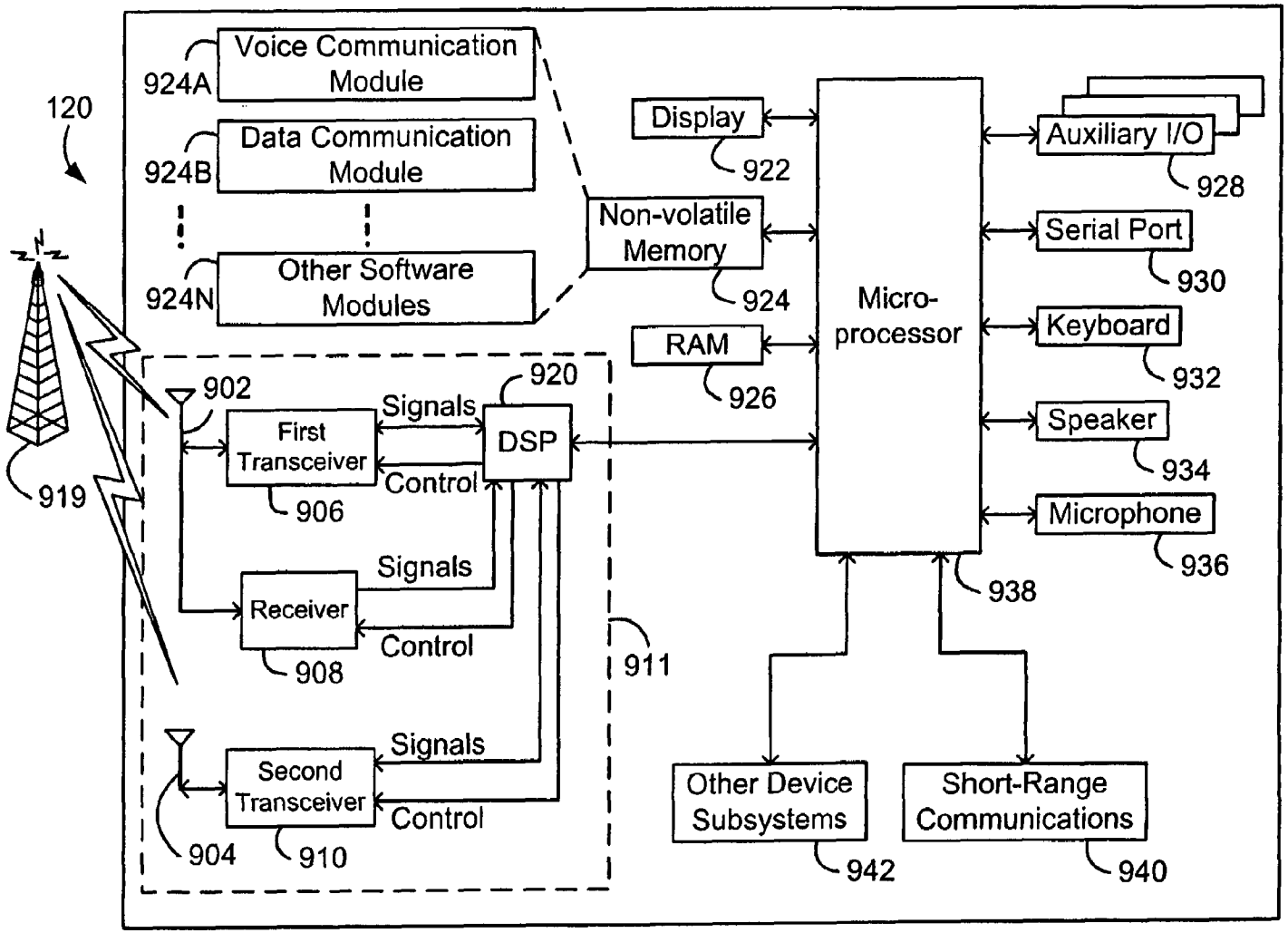
FIG. 14 is a block diagram of a mobile communication device.

FIG. 14 is a block diagram of a mobile communication device. The mobile device 120 is a dual-mode mobile device and includes a transceiver module 911, a microprocessor 938, a display 922, a non-volatile memory 924, random access memory (RAM) 926, one or more auxiliary input/output (I/O) devices 928, a serial port 930, a keyboard 932, a speaker 934, a microphone 936, a short-range wireless communications sub-system 940, and other device sub-systems 942.

The transceiver module 911 includes first and second antennas 902 and 904, a first transceiver 906, a receiver 908, a second transceiver 910, and a digital signal processor (DSP) 920. Although not shown separately in FIG. 14, it will be apparent from the foregoing description that the first antenna 906 includes both a first antenna element and a floating antenna element. In a preferred embodiment, the first and second antennas 902 and 904 are antenna elements in a multiple-element antenna.

Within the non-volatile memory 924, the mobile device 120 preferably includes a plurality of software modules 924A-924N that can be executed by the microprocessor 938 (and/or the DSP 920), including a voice communication module 924A, a data communication module 924B, and a plurality of other operational modules 924N for carrying out a plurality of other functions.

The mobile device 120 is preferably a two-way communication device having voice and data communication capabilities. Thus, for example, the mobile device 120 may communicate over a voice network, such as any of the analog or digital cellular networks, and may also communicate over a data network. The voice and data networks are depicted in FIG. 14 by the communication tower 919. These voice and data networks may be separate communication networks using separate infrastructure, such as base stations, network controllers, etc., or they may be integrated into a single wireless network. The transceivers 906 and 910 and the receiver 908 are normally configured to communicate with different networks 919.

The transceiver module 911 is used to communicate with the networks 919. The DSP 920 is used to send and receive communication signals to and from the transceivers 906 and 910 and to receive communications signals from the receiver 908, and provides control information to the transceivers 906 and 910 and the receiver 908. Information, which includes both voice and data information, is communicated to and from the transceiver module 911 via a link between the DSP 920 and the microprocessor 938.

The detailed design of the transceiver module 911, such as operating frequency bands, component selection, power level, etc., is dependent upon the communication network 919 in which the mobile device 120 is intended to operate. For example, in a mobile device intended to operate in a North American market, the first transceiver 906 may be designed to operate with any of a variety of voice communication networks, such as the Mobitex™ or DataTAC™ mobile data communication networks, AMPS, TDMA, CDMA, PCS, etc., whereas the receiver 908 is a GPS receiver configured to operate with GPS satellites and the second transceiver 910 is configured to operate with the GPRS data communication network and the GSM voice communication network in North America and possibly other geographical regions. Other types of data and voice networks, both separate and integrated, may also be utilized with a mobile device 120. The transceivers 906 and 910 may instead be configured for operation in different operating frequency bands of similar networks, such as GSM-900 and GSM-1900, or the CDMA bands of 800 MHz and 1900 MHz, for example. In some instances, a third transceiver is implemented instead of the receiver 908.

Depending upon the type of network or networks 919, the access requirements for the mobile device 120 may also vary. For example, in the Mobitex and DataTAC data networks, mobile devices are registered on the network using a unique identification number associated with each mobile device. In GPRS data networks, however, network access is associated with a subscriber or user of a mobile device. A GPRS device typically requires a subscriber identity module ("SIM") in order to operate a mobile device on a GPRS network. Local or non-network communication functions (if any) may be operable, without the SIM device, but a mobile device will be unable to carry out any functions involving communications over the data network 919, other than any legally required operations, such as '911' emergency calling.

After any required network registration or activation procedures have been completed, the mobile device 120 may the send and receive communication signals, including both voice and data signals, over the networks 919. Signals received by the antenna 902 or 904 from the communication network 919 are routed to one of the transceivers 906 and 910 or the receiver 908, which provide for signal amplification, frequency down conversion, filtering, and channel selection, for example, as well as analog to digital conversion. Analog to digital conversion of the received signal allows more complex communication functions, such as digital demodulation and decoding to be performed using the DSP 920. In a similar manner, signals to be transmitted to the network 919 are processed, including modulation and encoding, for example, by the DSP 920 and are then provided to one of the transceivers 906 and 910 for digital to analog conversion, frequency up conversion, filtering, amplification and transmission to the communication network 919 via the antenna 902 or 904.

In addition to processing the communication signals, the DSP 920 also provides for transceiver control. For example, the gain levels applied to communication signals in the transceivers 906 and 910 or the receiver 908 may be adaptively controlled through automatic gain control algorithms implemented in the DSP 920. Other transceiver control algorithms could also be implemented in the DSP 920 in order to provide more sophisticated control of the transceiver module 911.

The microprocessor 938 preferably manages and controls the overall operation of the dual-mode mobile device 120. Many types of microprocessors or microcontrollers could be used here, or, alternatively, a single DSP 920 could be used to carry out the functions of the microprocessor 938. Low-level communication functions, including at least data and voice communications, are performed through the DSP 920 in the transceiver module 911. Other, high-level communication applications, such as a voice communication application 924A, and a data communication application 924B may be stored in the non-volatile memory 924 for execution by the microprocessor 938. For example, the voice communication module 924A provides a high-level user interface operable to transmit and receive voice calls between the mobile device 120 and a plurality of other voice or dual-mode devices via the networks 919. Similarly, the data communication module 924B provides a high-level user interface operable for sending and receiving data, such as e-mail messages, files, organizer information, short text messages, etc., between the mobile device 120 and a plurality of other data devices via the networks 919. The microprocessor 938 also interacts with other device subsystems, such as the display 922, the non-volatile memory 924, the RAM 926, the auxiliary input/output (I/O) subsystems 928, the serial port 930, the keyboard 932, the speaker 934, the microphone 936, the short-range communications subsystem 940 and any other device subsystems generally designated as 942.

Some of the subsystems shown in FIG. 14 perform communication-related functions, whereas other subsystems may provide "resident" or on-device functions. Notably, some subsystems, such as the keyboard 932 and the display 922 are used for both communication-related functions, such as entering a text message for transmission over a data communication network, and device-resident functions such as a calculator, task list, or other PDA type functions.

Operating system software used by the microprocessor 938 is preferably stored in a persistent store such as the non-volatile memory 924. In addition to the operation system, which controls all of the low-level functions of the mobile device 120, the non-volatile memory 924 may include a plurality of high-level software application programs, or modules, such as the voice communication module 924A, the data communication module 924B, an organizer module (not shown), or any other type of software module 924N. These software modules are executed by the microprocessor 938 and provide a high-level interface between a user and the mobile device 120. This interface typically includes a graphical component provided through the display 922, and an input/output component provided through the auxiliary I/O 928, the keyboard 932, the speaker 934, and the microphone 936. The operating system, specific device applications or modules, or parts thereof, may be temporarily loaded into a volatile store such as the RAM 926 for faster operation. Moreover, received communication signals may also be temporarily stored to the RAM 926, before permanently writing them to a file system located in a persistent store such as the non-volatile memory 924. The non-volatile memory 924 may be implemented, for example, as a Flash memory component, or a battery backed-up RAM.

An exemplary application module 924N that may be loaded onto the mobile device 120 is a personal information manager (PIM) application providing PDA functionality, such as calendar events, appointments, and task items. This module 924N may also interact with the voice communication module 924A for managing phone calls, voice mails, etc., and may also interact with the data communication module for managing e-mail communications and other data transmissions. Alternatively, all of the functionality of the voice communication module 924A and the data communication module 924B may be integrated into the PIM module.

The non-volatile memory 924 preferably provides a file system to facilitate storage of PIM data items and other data on the mobile device 120. The PIM application preferably includes the ability to send and receive data items, either by itself, or in conjunction with the voice and data communication modules 924A and 924B, via the wireless networks 919. The PIM data items are preferably seamlessly integrated, synchronized and updated, via the wireless networks 919, with a corresponding set of data items stored or associated with a host computer system, thereby creating a mirrored system for data items associated with a particular user.

The mobile device 120 may also be manually synchronized with a host system by placing the device 120 in an interface cradle, which couples the serial port 930 of the mobile device 120 to the serial port of the host system. The serial port 930 may also be used to enable a user to set preferences through an external device or software application, or to download other application modules 924N for installation. This wired download path may be used to load an encryption key onto the device, which is a more secure method than exchanging encryption information via the wireless network 919. Interfaces for other wired download paths may be provided in the mobile device 120, in addition to or instead of the serial port 930. For example, a Universal Serial Bus (USB) port provides an interface to a similarly equipped personal computer.

Additional application modules 924N may be loaded onto the mobile device 120 through the networks 919, through an auxiliary I/O subsystem 928, through the serial port 930, through the short-range communications subsystem 940, or through any other suitable subsystem 942, and installed by a user in the non-volatile memory 924 or the RAM 926. Such flexibility in application installation increases the functionality of the mobile device 120 and may provide enhanced on-device functions, communication-related functions, or both. For example, secure communication applications enable electronic commerce functions and other such financial transactions to be performed using the mobile device 120.

When the mobile device 120 is operating in a data communication mode, a received signal, such as a text message or a web page download, is processed by the transceiver module 911 and provided to the microprocessor 938, which preferably further processes the received signal for output to the display 922, or, alternatively, to an auxiliary I/O device 928. A user of mobile device 120 may also compose data items, such as email messages, using the keyboard 932, which is preferably a complete alphanumeric keyboard laid out in the QWERTY style, although other styles of complete alphanumeric keyboards such as the known DVORAK style may also be used. User input to the mobile device 120 is further enhanced with a plurality of auxiliary I/O devices 928, which may include a thumbwheel input device, a touchpad, a variety of switches, a rocker input switch, etc. The composed data items input by the user may then be transmitted over the communication networks 919 via the transceiver module 911.

When the mobile device 120 is operating in a voice communication mode, the overall operation of the mobile device is substantially similar to the data mode, except that received signals are preferably be output to the speaker 934 and voice signals for transmission are generated by the microphone 936. Alternative voice or audio I/O subsystems, such as a voice message recording subsystem, may also be implemented on the mobile device 120. Although voice or audio signal output is preferably accomplished primarily through the speaker 934, the display 922 may also be used to provide an indication of the identity of a calling party, the duration of a voice call, or other voice call related information. For example, the microprocessor 938, in conjunction with the voice communication module and the operating system software, may detect the caller identification information of an incoming voice call and display it on the display 922.

A short-range communications subsystem 940 is also included in the mobile device 120. For example, the subsystem 940 may include an infrared device and associated circuits and components, or a short-range RF communication module such as a Bluetooth™ module or an 802.11 module to provide for communication with similarly-enabled systems and devices. Those skilled in the art will appreciate that "Bluetooth" and "802.11" refer to sets of specifications, available from the Institute of Electrical and Electronics Engineers, relating to wireless personal area networks and wireless local area networks, respectively.

This written description uses examples to disclose the invention, including the best mode, and also to enable any person skilled in the art to make and use the invention. The invention may include other examples that occur to those skilled in the art.

We claim:

1. A multiple-element antenna for a wireless communication device, comprising:

a first antenna element having a first operating frequency band, wherein the first antenna element comprises a first conductor section and a second conductor section; and a floating antenna element positioned adjacent the first antenna element to electromagnetically couple to the first antenna element within a second operating frequency band that is dissimilar from the first operating frequency band, wherein the floating antenna element comprises a patch and a plurality of conductor sections connected to the patch.

2. The multiple-element antenna of claim 1, wherein the plurality of conductor sections comprises a pair of conductor sections adjacent opposite sides of the first conductor section of the first antenna element.

3. The multiple-element antenna of claim 1, wherein dimensions of the first antenna element are selected to tune the first antenna element to the first operating frequency band, and wherein dimensions and position of the floating antenna element are selected to control electromagnetic coupling with the first antenna element to tune the multiple-element antenna to the second operating frequency band.

4. The multiple-element antenna of claim 1, further comprising a second antenna element configured for operation within a third operating frequency band and having a feeding port.

5. The multiple-element antenna of claim 4, wherein the second antenna element comprises a top conductor section connected to the feeding port and positioned adjacent the first antenna element.

6. The multiple-element antenna of claim 5, further comprising a parasitic coupler positioned adjacent the first antenna element and the second antenna element to electromagnetically couple with both the first antenna element and the second antenna element.

7. The multiple-element antenna of claim 6, wherein the parasitic coupler has a structure selected from the group consisting of: a substantially straight conductor, a plurality of stacked parasitic elements, and a folded conductor comprising a first conductor section and a second conductor section connected to the first conductor section.

8. The multiple-clement antenna of claim 5, wherein the top conductor section of the second antenna element includes a meandering line having an electrical length, and wherein the electrical length of the meandering line is selected to tune the second antenna element to the third operating frequency band.

9. The multiple-element antenna of claim 1, wherein the multiple-element antenna is mounted within a housing of the wireless communication device.

10. The multiple-element antenna of claim 9, wherein the multiple-element antenna is mounted to an inside surface of the wireless communication device.

11. The multiple-element antenna of claim 1, wherein the multiple-element antenna is mounted on the wireless communication device to position the floating antenna element partially along a top surface of the wireless communication device.

12. The multiple-element antenna of claim 1, wherein the wireless communication device is selected from the group consisting of: a data communication device, a voice communication device, a dual-mode communication device, a mobile telephone having data communications functionality, a personal digital assistant (PDA) enabled for wireless communication, a wireless email communication device, and a wireless modem.

13. The multiple-element antenna of claim 4, wherein the first operating frequency band comprises a 1900 MHz frequency band, wherein the second operating frequency band comprises 1575 MHz frequency band, and wherein the third operating frequency band comprises an 800 MHz frequency band.

14. The multiple-element antenna of claim 4, wherein the first operating frequency band includes both an 1800 MHz communication frequency band and a 1900 MHz communication frequency band, wherein the second operating frequency band comprises a 1575 MHz frequency band, and wherein the third operating frequency band comprises a 900 MHz frequency band.

15. The multiple-clement antenna of claim 1, wherein the second operating frequency band is determined by the overall length of the first antenna element and the floating antenna element.

16. A multiple-element antenna for a wireless communication device, comprising:

a first antenna element having a first operating frequency band;

a floating antenna element positioned adjacent the first antenna element to electromagnetically couple to the first antenna element within a second operating frequency band that is dissimilar from the first operating frequency band; and a second antenna element configured for operation within a third operating frequency band and having a feeding port.

17. The multiple-element antenna of claim 16, wherein the first antenna element comprises a first conductor section and a second conductor section.

18. The multiple-element antenna of claim 16, wherein the floating antenna element comprises a patch and a plurality of conductor sections connected to the patch.

19. The multiple-element antenna of claim 18, wherein the plurality of conductor sections comprises a pair of conductor sections adjacent opposite sides of the first conductor section of the first antenna element.

20. The multiple-element antenna of claim 16, wherein dimensions of the first antenna element are selected to tune the first antenna element to the first operating frequency band, and wherein dimensions and position of the floating antenna element are selected to control electromagnetic coupling with the first antenna element to tune the multiple-element antenna to the second operating frequency band.

21. The multiple-element antenna of claim 16, wherein the second antenna element comprises a top conductor section connected to the feeding port and positioned adjacent the first antenna element.

22. The multiple-element antenna of claim 21, further comprising a parasitic coupler positioned adjacent the first antenna element and the second antenna element to electromagnetically couple with both the first antenna element and the second antenna element.

23. The multiple-element antenna of claim 22, wherein the parasitic coupler has a structure selected from the group consisting of: a substantially straight conductor, a plurality of stacked parasitic elements, and a folded conductor comprising a first conductor section and a second conductor section connected to the first conductor section.

24. The multiple-element antenna of claim 21, wherein the top conductor section of the second antenna element includes a meandering line having an electrical length, and wherein the electrical length of the meandering line is selected to tune the second antenna element to the third operating frequency band.

25. The multiple-element antenna of claim 16, wherein the multiple-element antenna is mounted within a housing of the wireless communication device.

26. The multiple-element antenna of claim 25, wherein the multiple-element antenna is mounted to an inside surface of the wireless communication device.

27. The multiple-element antenna of claim 16, wherein the multiple-element antenna is mounted on the wireless communication device to position the floating antenna element partially along a top surface of the wireless communication device.

28. The multiple-element antenna of claim 16, wherein the wireless communication device is selected from the group consisting of: a data communication device, a voice communication device, a dual-mode communication device, a mobile telephone having data communications functionality, a personal digital assistant (PDA) enabled for wireless communication, a wireless email communication device, and a wireless modem.

29. The multiple-element antenna of claim 16, wherein the first operating frequency band comprises a 1900 MHz frequency band, wherein the second operating frequency band comprises 1575 MHz frequency band, and wherein the third operating frequency band comprises an 800 MHz frequency band.

30. The multiple-element antenna of claim 16, wherein the first operating frequency band includes both an 1800 MHz communication frequency band and a 1900 MHz communication frequency band, wherein the second operating frequency band comprises a 1575 MHz frequency band, and wherein the third operating frequency band comprises a 900 MHz frequency band.

31. The multiple-element antenna of claim 16, wherein the second operating frequency band is determined by the overall length of the first antenna element and the floating antenna element.

32. A multiple-element antenna for a wireless communication device, comprising:

a first antenna element having a first operating frequency band; and a floating antenna element positioned adjacent the first antenna element to electromagnetically couple to the first antenna element within a second operating frequency band that is dissimilar from the first operating frequency band;

wherein the multiple-element antenna is mounted on the wireless communication device to position the floating antenna element partially along a top surface of the wireless communication device.

33. The multiple-element antenna of claim 32, wherein the first antenna element comprises a first conductor section and a second conductor section.

34. The multiple-element antenna of claim 32, wherein the floating antenna element comprises a patch and a plurality of conductor sections connected to the patch.

35. The multiple-element antenna of claim 34, wherein the plurality of conductor sections comprises a pair of conductor sections adjacent opposite sides of the first conductor section of the first antenna element.

36. The multiple-element antenna of claim 32, wherein dimensions of the first antenna element are selected to tune the first antenna element to the first operating frequency band, and wherein dimensions and position of the floating antenna element are selected to control electromagnetic coupling with the first antenna element to tune the multiple-element antenna to the second operating frequency band.

37. The multiple-element antenna of claim 32, further comprising a second antenna element configured for operation within a third operating frequency band and having a feeding port.

38. The multiple-element antenna of claim 37, wherein the second antenna element comprises a top conductor section connected to the feeding port and positioned adjacent the first antenna element.

39. The multiple-element antenna of claim 37, further comprising a parasitic coupler positioned adjacent the first antenna element and the second antenna element to electromagnetically couple with both the first antenna element and the second antenna element.

40. The multiple-element antenna of claim 37, wherein the top conductor section of the second antenna element includes a meandering line having an electrical length, and wherein the electrical length of the meandering line is selected to tune the second antenna element to the third operating frequency band.

41. The multiple-element antenna of claim 32, wherein the parasitic coupler has a structure selected from the group consisting of: a substantially straight conductor, a plurality of stacked parasitic elements, and a folded conductor comprising a first conductor section and a second conductor section connected to the first conductor section.

42. The multiple-element antenna of claim 32, wherein the multiple-element antenna is mounted within a housing of the wireless communication device.

43. The multiple-element antenna of claim 42, wherein the multiple-element antenna is mounted to an inside surface of the wireless communication device.

44. The multiple-element antenna of claim 32, wherein the multiple-element antenna is mounted on the wireless communication device to position the floating antenna element partially along a top surface of the wireless communication device.

45. The multiple-element antenna of claim 32, wherein the wireless communication device is selected from the group consisting of: a data communication device, a voice communication device, a dual-mode communication device, a mobile telephone having data communications functionality, a personal digital assistant (PDA) enabled for wireless communication, a wireless email communication device, and a wireless modem.

46. The multiple-element antenna of claim 32, wherein the first operating frequency band comprises a 1900 MHz frequency band, wherein the second operating frequency band comprises 1575 MHz frequency band, and wherein the third operating frequency band comprises an 800 MHz frequency band.

47. The multiple-element antenna of claim 32, wherein the first operating frequency band includes both an 1800 MHz communication frequency band and a 1900 MHz communication frequency band, wherein the second operating frequency band comprises a 1575 MHz frequency band, and wherein the third operating frequency band comprises a 900 MHz frequency band.

48. The multiple-element antenna of claim 32, wherein the second operating frequency band is determined by the overall length of the first antenna element and the floating antenna element.

* * * * *